US007419411B2

(12) United States Patent
Kaneko

(10) Patent No.: US 7,419,411 B2
(45) Date of Patent: Sep. 2, 2008

(54) EXPOSED-SPRING FEMALE TERMINAL

(75) Inventor: Jun Kaneko, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/783,659

(22) Filed: Apr. 11, 2007

(65) Prior Publication Data

US 2007/0243772 A1 Oct. 18, 2007

(30) Foreign Application Priority Data

Apr. 12, 2006 (JP) ..... 2006-110331

(51) Int. Cl.
*H01R 11/22* (2006.01)

(52) U.S. Cl. ..... 439/852; 439/851

(58) Field of Classification Search ..... 439/842, 439/843, 850–852

See application file for complete search history.

(56) References Cited

U.S. PATENT DOCUMENTS 5,443,592 A * 8/1995 Ittah et al. ..... 439/851
6,527,601 B2 * 3/2003 Chen ..... 439/852

FOREIGN PATENT DOCUMENTS

JP 10-055835 A 2/1998

* cited by examiner

*Primary Examiner*—Tho Dac Ta
*Assistant Examiner*—Travis Chambers
(74) *Attorney, Agent, or Firm*—Rader, Fishman & Grauer, PLLC

(57) ABSTRACT

The present invention is an exposed-spring female terminal comprising a tubular body having two lateral walls and two vertical walls and extending in a depth direction; a connecting part being arranged with the body on a rear side in the depth direction, being provided integrally with the body and being structured to connect to an electric wire, etc.; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction; and the leaf spring being provided with a wider-width part extending from the restrained part to the resilient deformation part, of which plate width being larger than the dimension between the inner faces of the two vertical walls; and the two vertical walls being provided with openings for receiving the wider-width part.

11 Claims, 8 Drawing Sheets

EXPOSED-SPRING FEMALE TERMINAL

BACKGROUND OF THE INVENTION

1. Field of the Invention

The present invention belongs to a technical field of female terminals comprising a tubular body, a connecting part provided on said body to connect to an electric wire, and a leaf spring provided inside said body.

2. Description of Related Art

Japanese Patent Publication (Unexamined) No. HEISEI 10-55835 discloses a female terminal fitting comprising a terminal body and a protective cover covering a portion of said terminal body. The terminal body is structured by joining, via a joining part, an insertion part made by bending a thin metal plate and a barrel part to which an end of an electric wire is to be connected by crimping. Inside the insertion part, a resilient contact piece cut and raised from a bottom plate on a rear end side is provided. When a counterpart terminal is inserted into the female terminal fitting, the resilient contact piece will undergo elastic deformation to provide a contact pressure.

SUMMARY OF THE INVENTION

In such a terminal fitting, as the resilient contact piece is stored inside the terminal body, the width of the resilient contact piece is narrower than the width of an internal space of the terminal body. Accordingly, if one attempts to make the terminal fitting more compact by reducing the width of the terminal body, the width of the resilient contact piece will be narrowed and the flexural rigidity of the resilient contact piece will be reduced, making it difficult to secure an adequate contact pressure. Moreover, if one attempts to enhance the contact pressure of the resilient contact piece without altering the width of the terminal body, it will be difficult to do so.

The present invention covers a female terminal in which a leaf spring is stored inside a tubular body, like the above-mentioned terminal fitting. One object of the present invention is to provide a female terminal wherein the width of a portion of a leaf spring to which a large bending force is loaded is widened than the rest thereof to increase a resilient force that can be obtained from the leaf spring, and in turn to make the female terminal more compact or enhance the contact pressure.

The exposed-spring female terminal according to the present invention comprises a tubular body having two lateral walls facing in a height direction and opposing to each other and two vertical walls facing in a width direction perpendicular to the height direction and opposing to each other, and extending in a depth direction perpendicular to both the height direction and the width direction; a connecting part being arranged with the body on a rear side in the depth direction, being provided integrally with the body and being structured to connect to a conductor such as electric wire; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction; the leaf spring being provided with a wider-width part extending from the restrained part to the resilient deformation part, of which plate width being larger than the dimension between the inner faces of the two vertical walls; and the two vertical walls being provided with openings for receiving the wider-width part.

When a counterpart male terminal is inserted into this exposed-spring female terminal, the resilient deformation part of the leaf spring will be pushed by the male terminal to undergo resilient deformation in the height direction to provide a contact pressure between both the terminals. In this case, the largest bending force is loaded on a portion extending from the restrained part to the resilient deformation part of the leaf spring. However, as this portion has a plate width larger than the dimension between the inner faces of the two vertical walls, thus providing the wider-width part, its flexural rigidity is higher in comparison with a conventional case wherein the width of the leaf spring is narrower than the width of the internal space of the body. Accordingly, even when one attempts to make the female terminal more compact by reducing the body width less than that of a conventional female terminal, a sufficient contact pressure will be secured. Moreover, it is also possible to enhance the contact pressure of the leaf spring without changing the width of the body in comparison with a conventional female terminal. Furthermore, as the body is made tubular, a high rigidity is provided, and the body will be hardly deformed under external forces. As the leaf spring is retained inside the body except its wider-width part, the leaf spring is protected against external forces.

In the exposed-spring female terminal of the present invention, the restrained part of the leaf spring may be provided with an integral part being integrally provided with the body or a fixed part being fixed onto the body.

In this case, the integral part is, for example, a bent portion when the leaf spring is obtained by bending said portion from a vertical wall or a lateral wall of the body. The fixed part, on the other hand, is, for example, a fixed portion being a separate member from the body and being fixed onto the body by some methods including thermal fusion, swaging, press fitting and bonding.

In the exposed-spring female terminal of the present invention, the restrained part of the leaf spring may be provided with a support part which extends from the integral part or the fixed part toward the resilient deformation part and is restrained from deformation by contacting the body.

In this case, the support part, for example, extends along a lateral wall of the body. Moreover, the support part may contact the body even when the resilient deformation part is in a free state or the support part may be so arranged that it is free from the body when the resilient deformation part is in a free state and it contacts the body when the resilient deformation part undergoes resilient deformation.

The exposed-spring female terminal of the present invention may be so structured that the resilient deformation part has a curved part extending from the restrained part and bending in an approximately-U-shaped form when seen in the width direction, and an end on the curved part side of the restrained part and the curved part of the resilient deformation part constitute the wider-width part of which plate width being larger than the dimension between the inner walls of the two vertical walls.

With this arrangement, when a counterpart male terminal is inserted into this exposed-spring female terminal, the resilient deformation part of the leaf spring will be pushed by the male terminal to undergo resilient deformation in the height direction, approaching toward the restrained part, and a contact pressure will be obtained between both the terminals. In this case, the largest bending force is loaded on the end on the curved part side of the restrained part and the curved part of the resilient deformation part. However, as this portion is the wider-width part, its flexural rigidity is larger than the conventional case wherein the width of the leaf spring is made narrower than the width of the internal space of the body. Accordingly, if one attempts to make the female terminal smaller by reducing the width of the body than that of a conventional female terminal, a sufficient contact pressure will be secured. Moreover, it is also possible to enhance the contact pressure of the leaf spring without changing the body width in comparison with a conventional female terminal. Furthermore, as the body is made tubular, a high rigidity is secured, and the body will be hardly deformed under external forces. As the leaf spring is retained inside the body except the wider-width part, the leaf spring is protected against external forces.

The exposed-spring female terminal of the present invention may be provided with a secondary leaf spring on the restrained part on the side, in the depth direction, opposite to the side on which the resilient deformation part is provided, said secondary leaf spring extends from the restrained part in the depth direction and constitutes a double spring together with the leaf spring.

With this arrangement, when a counterpart male terminal is inserted into this exposed-spring female terminal, the resilient deformation part of the leaf spring will be pushed by the male terminal to undergo resilient deformation in the height direction and approach toward the restrained part and then contact the secondary leaf spring, and in turn, both the leaf spring and the secondary leaf spring will undergo resilient deformation together to provide a contact pressure between both the terminals.

The exposed-spring female terminal of the present invention may be so structured that the wider-width part of the leaf spring is provided in one end in the depth direction of the body and the openings are provided in the ends in the depth direction of the two vertical walls.

With this arrangement, as the openings are provided in the ends of the vertical walls, the openings hardly induce a decrease in the rigidity of the body.

The exposed-spring female terminal of the present invention may be provided with a stopper on the vertical wall between the leaf spring and the lateral wall, said stopper is to prevent excessive deformation of the leaf spring by contacting the leaf spring almost undergoing excessive deformation.

With this arrangement, the leaf spring is prevented from undergoing excessive deformation.

DETAILED DESCRIPTION OF THE INVENTION

Figure 1:
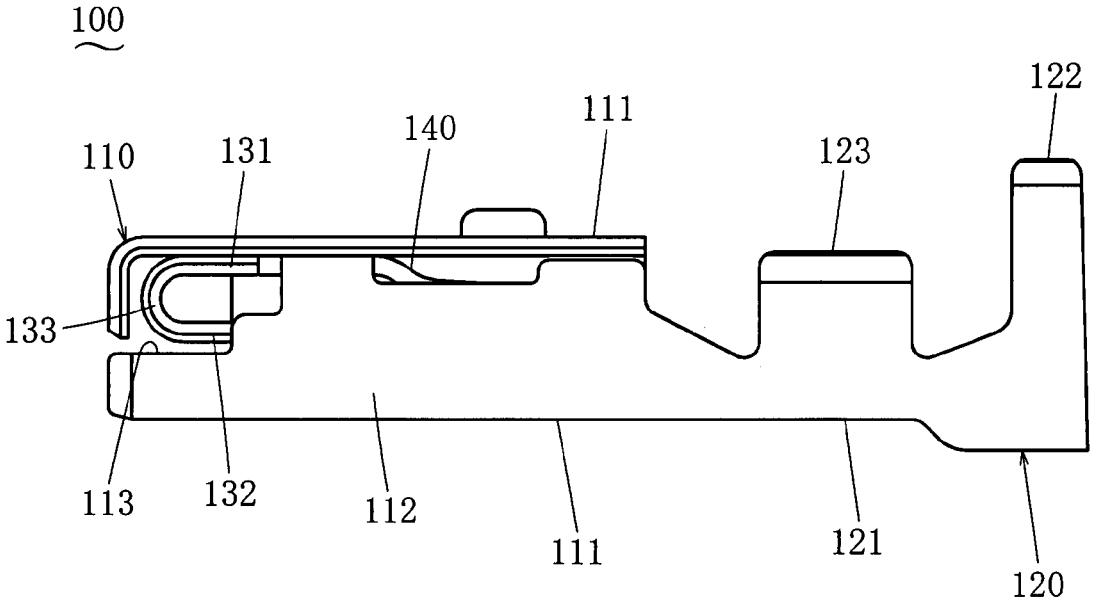
FIG. 1 is a side view of the exposed-spring female terminal of the first embodiment.
Figure 2:
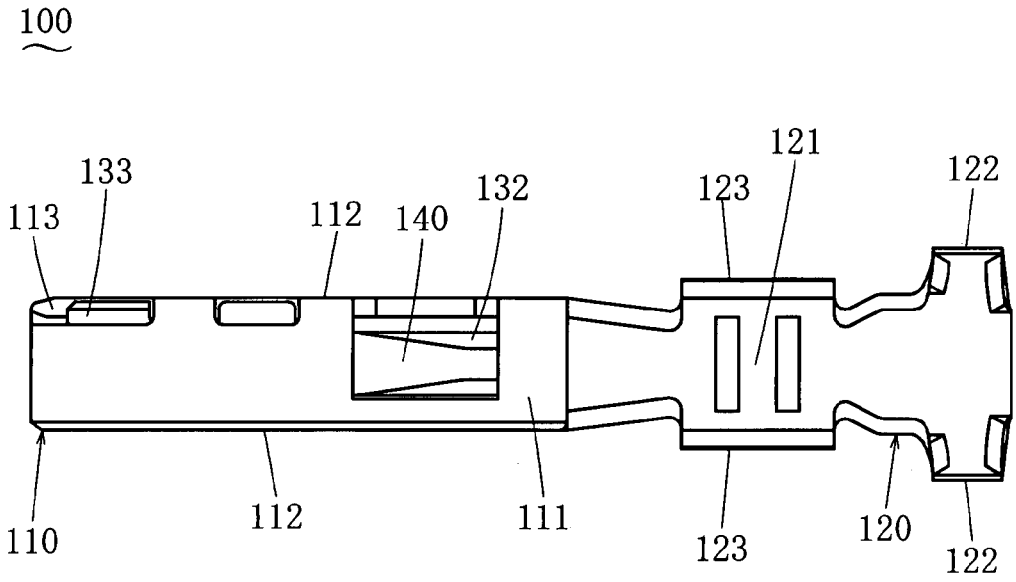
FIG. 2 is a plan view of the exposed-spring female terminal of the first embodiment.

In the following, some embodiments of the present invention will be described. FIG. 1 through FIG. 8 illustrate the exposed-spring female terminal 100 of the first embodiment. This exposed-spring female terminal 100 fits with a well-known male terminal such as plug (not illustrated). It is suffice for the male terminal to have a rod-shaped or plate-shaped contact part having electric conductivity. The exposed-spring female terminal 100 may be used by storing it inside a housing (not illustrated) or it may be used as it is. In the following, a height direction, a width direction and a depth direction all perpendicular to each other are defined, and the description will be given on the basis of them. With reference to FIG. 1, the left-right direction in the diagram is the depth direction, the left is the front and the right is the rear, the top-bottom direction of the diagram is the height direction, and the direction perpendicular to the paper plane of the diagram is the width direction.

This exposed-spring female terminal 100 is made of an electrically conductive material and comprises a tubular body 110 and a connecting part 120 that is aligned with the body 110 on the rear side in the depth direction and is integrally provided with the body 110.

A male terminal is inserted into the body 110 from the front in the depth direction. And the inserted male terminal is withdrawn from the body 110 frontward in the depth direction. The body 110 comprises two lateral walls 111 facing in the height direction and opposing to each other and two vertical walls 112 facing in the width direction and opposing to each other. These two lateral walls 111 and two vertical walls 112 are so provided that the respective originally-neighboring walls are integral to each other. The lateral walls 111 have, when seen in their thickness direction, a substantially rectangular form, one side being in the depth direction and the other side in the width direction, and the vertical walls 112 have, when seen in their thickness direction, a substantially rectangular form, one side being in the depth direction and the other side in the height direction. As the largest area faces of both the lateral walls 111 are perpendicular to the height direction, the lateral walls 111 face in the height direction. The lateral walls 111 are opposed to each other in the height direction. On the other hand, as the larger area faces of both the two vertical walls 112 are perpendicular to the width direction, the vertical walls 112 face in the width direction. The two vertical walls 112 are opposed to each other in the width direction. The body 110 is comprised of the two lateral walls 111 and the two vertical walls 112 in a tubular form and extends in the depth direction.

The connecting part 120 is structured to connect to a wire. The connecting part 120 is comprised of a base 121 having a U-shaped section and extending rearward in the depth direction from the lateral wall 111 and the vertical walls 112 of the body 110, and an insulation barrel 122 and a wire barrel 123 rising from both the ends in the width direction of the base 121, and is structured to crimp-connect a wire by crimping the insulation barrel 122 on the insulation of the wire and crimping the wire barrel 123 on the core of the wire exposed from the insulation. However, the connecting part may be structured, for example, to connect to a wire by insulation displacement connection or may be structured to connect to a wire by piercing. The connecting part may be structured to connect to a conductor other than a wire. Other conductors include, for example, flat-type flexible cables such as FFC (flexible flat cable) and FPC (flexible printed circuit).

A leaf spring 130 is provided inside the body 110. The leaf spring 130 is formed of a plate piece, and the plate width direction of this plate piece substantially coincides with the above-mentioned width direction. The leaf spring 130 is comprised of a restrained part 131 being restrained by the body 110 and a resilient deformation part 132 extending from the restrained part 131. The resilient deformation part 132 extends from the restrained part 131 in the depth direction when seen in the height direction. The resilient deformation part 132 is capable of undergoing resilient deformation in the height direction.

Figure 3:
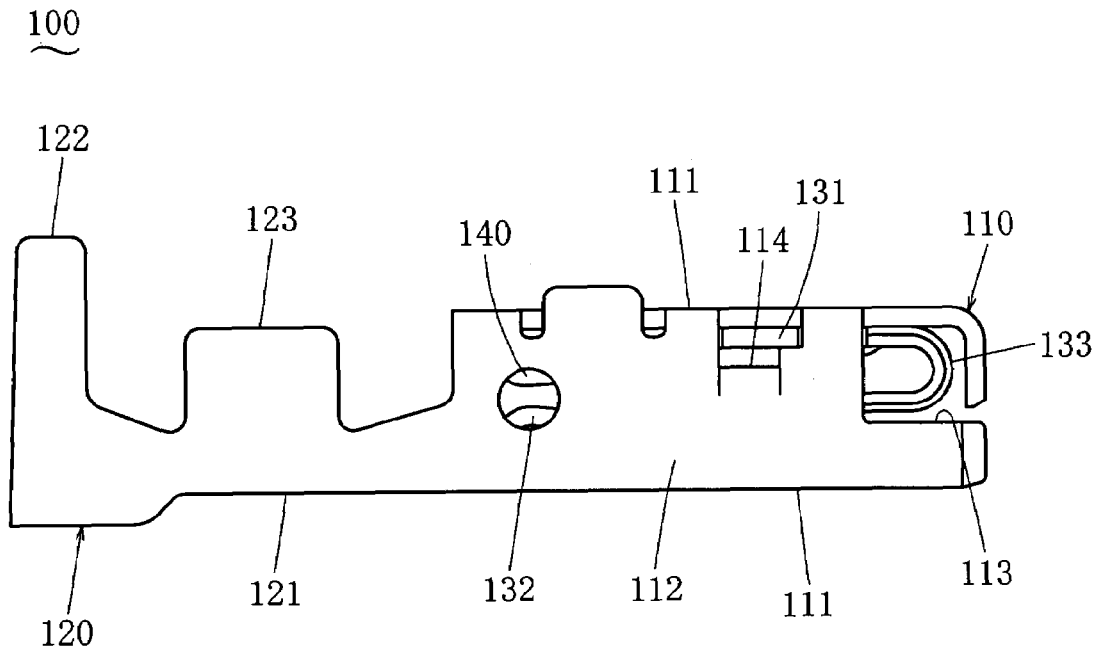
FIG. 3 is a side view of the exposed-spring female terminal of the first embodiment seen from the side opposite to that of FIG. 1.
Figure 4:
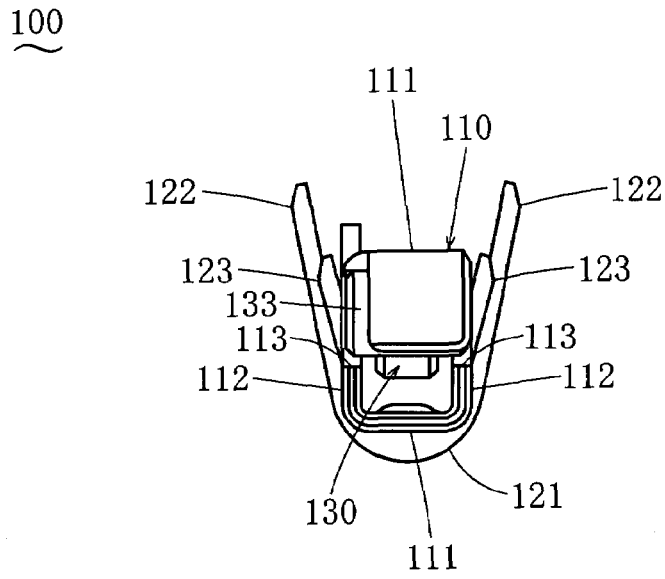
FIG. 4 is a front view of the exposed-spring female terminal of the first embodiment.
Figure 5:
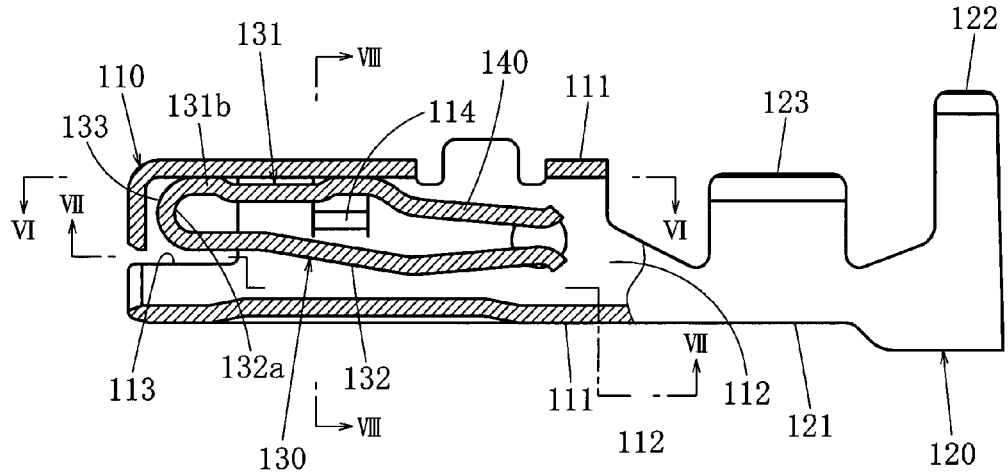
FIG. 5 is a side view of the exposed-spring female terminal of the first embodiment illustrating the body, the leaf spring and the secondary leaf spring thereof in longitudinal section.
Figure 6:
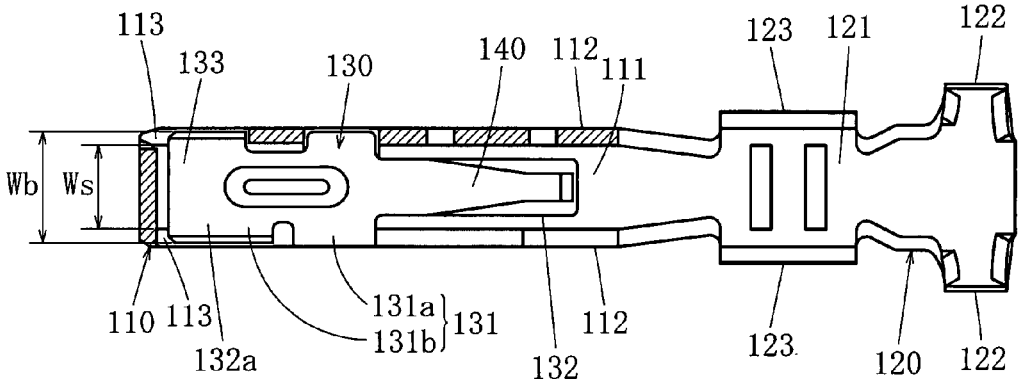
FIG. 6 is a sectional view along the line VI-VI of FIG. 5.
Figure 7:
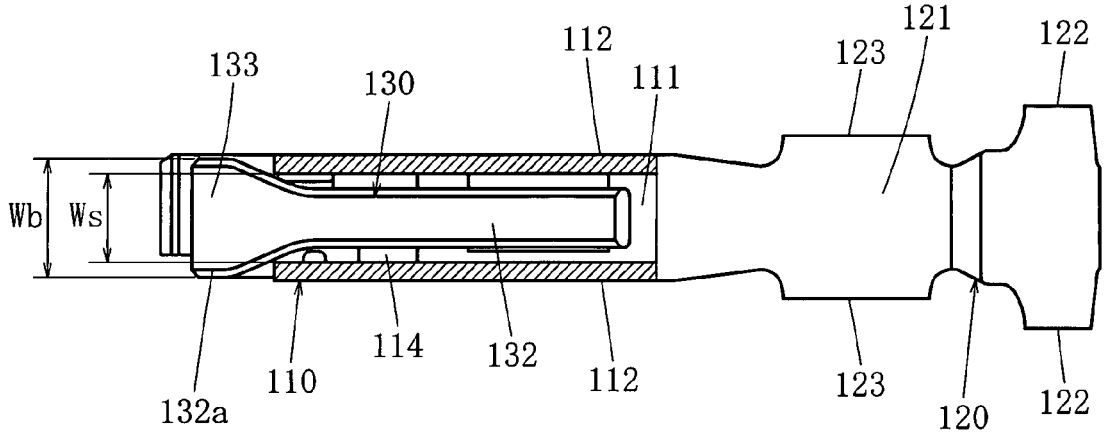
FIG. 7 is a sectional view along the line VII-VII of FIG. 5.
Figure 8:
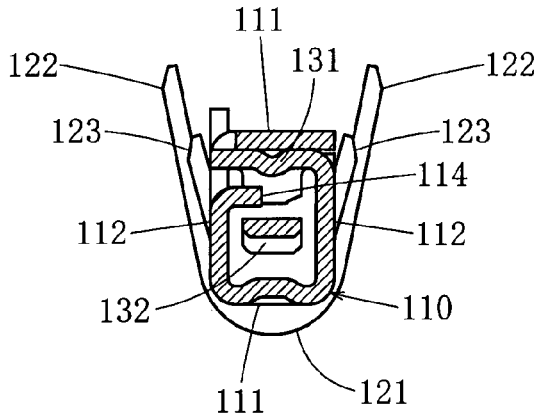
FIG. 8 is a sectional view along the line VIII-VIII of FIG. 5.

A wider-width part 133 of which plate width is wider than the rest is provided in the leaf spring 130 from the restrained part 131 to the resilient deformation part 132. This wider-width part 133 has a plate width Wb that is larger than the dimension Ws between the inner faces of the two vertical walls 112. The two vertical walls 112 of the body 110 are provided with openings 113 that receive the wider-width part 133. As illustrated in FIG. 6 and FIG. 7, the edges in the width direction of the wider-width part 133 are located in the outer side of the inner faces of the vertical walls 112 in the width direction. The outer side in the width direction is in which the dimension in the width direction from the central position is greater. In the case of this first embodiment, the edges in the width direction of the wider-width part 133 go beyond the inner faces of the vertical walls 112 and substantially reach the outer faces of the vertical walls 112, but they may extend short of the outer faces or they may extend into the outer side of the outer faces in the width direction. The plate width of the resilient deformation part 132 with the exception of the wider-width part 133 is smaller than the dimension Ws between the inner faces of the two vertical walls 112. As illustrated in FIG. 1 and FIG. 3, the wider-width part 133 does not contact the edges of the openings 113 in the vertical walls 112, and the movement of the wider-width part 133 is not restrained by the vertical walls 112. However, of the wider-width part 133, a portion belonging to the restrained part 131 may be in contact with the edges of the openings 113 in the vertical walls 112.

The restrained part 131 of the leaf spring 130 is provided with an integral part 131*a* being integrally provided with the body 110. As illustrated in FIG. 1 and FIG. 6, the integral part 131*a* is a bent portion that is obtained when the leaf spring 130 is bent from the vertical wall 112 of the body 110.

The restrained part 131 of the leaf spring 130 is also provided with a support part 131*b*, which extends from the integral part 131*a* toward the resilient deformation part 132 and contacts the body 110, thus its deformation is restrained. This support part 131*b* extends along the lateral wall 111 of the body 110. The support part 131*b* is already in contact with the body 110 even when the resilient deformation part 132 is in a free state. However, the support part may be so structured that it is kept away from the body when the resilient deformation part is in a free state and it contacts the body when the resilient deformation part undergoes resilient deformation. The leaf spring 130 is provided with a rib for reinforcement by forming irregularities in the height direction in a portion extending from the integral part 131*a* to the support part 131*b*. However, the position and configuration of the rib are not limited by this, and a rib may be omitted.

The resilient deformation part 132 is provided with a curved part 132*a* that extends from the restrained part 131 and curves in an approximately U-shape when seen in the width direction. An end of the restrained part 131 on the side of the curved part 132*a* and the curved part 132*a* of the resilient deformation part 132 constitute the wider-width part 133 of which plate width Wb is greater than the dimension Ws between the inner faces of the two vertical walls 112.

In the restrained part 131, on a side opposite, in the depth direction, to the side on which the resilient deformation part 132 is provided, a secondary leaf spring 140 extending in the depth direction from the restrained part 131 is provided. This secondary leaf spring 140 constitutes a double spring together with the above-mentioned leaf spring 130. The secondary leaf spring 140 is formed from a plate piece, and the plate width direction of the plate piece coincides substantially with the above-mentioned width direction. The secondary leaf spring 140 substantially overlaps with the resilient deformation part 132 of the leaf spring 130 when seen in the height direction, and there is a gap between them when seen in the width direction. The secondary leaf spring 140 is capable of undergoing resilient deformation in the height direction, and is so structured that when the resilient deformation part 132 of the leaf spring 130 undergoes resilient deformation in the height direction to approach toward the restrained part 131, the resilient deformation part 132 will contact the secondary leaf spring 140, and then the leaf spring 130 and the secondary leaf spring 140 will jointly undergo resilient deformation.

The wider-width part 133 of the leaf spring 130 is provided in the front end in the depth direction of the body 110. And the openings 113 are provided at the front ends in the depth direction of the two vertical walls 112.

A stopper 114 is provided on the vertical wall 112 between the leaf spring 130 and the lateral wall 111, said stopper 114 is to prevent excessive deformation of the leaf spring 130 by contacting the leaf spring 130 almost undergoing excessive deformation. This stopper 114 is a plate piece extending from the vertical wall 112 in the width direction, and it is located between the restrained part 131 and the resilient deformation part 132 of the leaf spring 130, and when the resilient deformation part 132 almost undergoes excessive resilient deformation, the stopper 114 will contact the resilient deformation part 132 to prevent excessive deformation and protect the resilient deformation part 132 against damage.

The structure of the body 110 and the leaf spring 130 of the exposed-spring female terminal 100 of the first embodiment will be described in detail. This exposed-spring female terminal 100 is produced by bending a single blank provided in a given configuration. This blank is formed by, for example, punching it out of a material plate with dies. Ends in the height direction of the vertical walls 112 are integrally provided on both the ends in the width direction of the lateral wall 111, respectively. More specifically, one end in the height direction of one vertical wall 112 is integrally provided on one end in the width direction of the lateral wall 111, and one end in the height direction of the other vertical wall 112 is integrally provided on the other end in the width direction of the lateral wall 111. And, of the ends in the height direction of one vertical wall 112, the remaining end, in other words, the end being remoter from said lateral wall 111 is integrally provided with one end in the width direction of the other lateral wall 111. Moreover, of the ends in the height direction of the other vertical wall 112, the remaining end, in other words, the end being remoter from said lateral wall 111 is integrally provided with one end in the width direction of the leaf spring 130. Furthermore, this lateral wall 111 and the leaf spring 130 are overlapped with each other, the lateral wall 111 on the outer side and the leaf spring 130 on the inner side. To put it in other words, on edges extending substantially in the depth direction on both ends in the width direction of the lateral wall 111, one of the edges extending substantially in the depth direction on both sides in the height direction of each vertical wall 112 is integrally provided, respectively, and on the other edges of these vertical walls 112, one of the edges extending substantially in the depth direction on both sides in the width direction of the other lateral wall 111 and the same of the leaf spring 130 are integrally provided, respectively. However, the structure of the body 110 and the leaf spring 130 is not limited to this. It is sufficient for the body to be in a tubular form having two lateral walls facing in the height direction and opposing to each other and two vertical walls facing in the width direction and opposing to each other. On the other hand, it is sufficient for the leaf spring to be arranged inside the body with the plate width direction of the leaf spring being aligned substantially in the width direction and be provided with a restrained part being restrained by the body and a resilient deformation part extending from the restrained part in the depth direction when seen in the height direction and being capable of undergoing resilient deformation in the height direction.

Accordingly, when a counterpart male terminal is inserted into the exposed-spring female terminal 100 of the above-mentioned first embodiment, the resilient deformation part 132 of the leaf spring 130 will be pushed by the male terminal to undergo resilient deformation in the height direction to provide a contact pressure between both the terminals. In this case, the largest bending force is loaded on a portion extending from the restrained part 131 to the resilient deformation part 132 of the leaf spring 130. However, as this portion has a plate width Wb greater than the dimension Ws between the inner faces of the two vertical walls 112, thus providing the wider-width part 133, its flexural rigidity is higher in comparison with a conventional case wherein the width of the leaf spring is narrower than the width of the internal space of the body. Accordingly, even when one attempts to make the female terminal more compact by reducing the body width less than that of a conventional female terminal, a sufficient contact pressure will be secured. Moreover, it is also possible to enhance the contact pressure of the leaf spring without changing the width of the body in comparison with a conventional female terminal. Furthermore, as the body 100 is made tubular, a high rigidity is provided, and the body will be hardly deformed under external forces. As the leaf spring 130 is retained inside the body 110 except its wider-width part 133, the leaf spring 130 is protected against external forces.

It is sufficient for the leaf spring of the exposed-spring female terminal of the present invention that the leaf spring has the resilient deformation part extending from the restrained part in the depth direction when seen in the height direction, and the wider-width part of which plate width being larger than the dimension between the inner faces of the two vertical walls, and extending from the restrained part to the resilient deformation part, and the two vertical walls are provided with openings for receiving the wider-width part. However, in the exposed-spring female terminal 100 of the first embodiment, the resilient deformation part 132 has a curved part 132*a* extending from the restrained part 131 and bending in an approximately-U-shaped form when seen in the width direction, and an end on the curved part 132*a* side of the restrained part 131 and the curved part 132*a* of the resilient deformation part 132 constitute a wider-width part 133 of which plate width Wb being greater than the dimension Ws between the inner faces of the two vertical walls 112. With this arrangement, when a counterpart male terminal is inserted into this exposed-spring female terminal 100, the resilient deformation part 132 of the leaf spring 130 will be pushed by the male terminal to undergo resilient deformation in the height direction, approaching toward the restrained part 131, and a contact pressure will be obtained between both the terminals. In this case, the largest bending force is loaded on the end on the curved part 132*a* side of the restrained part 131 and the curved part 132*a* of the resilient deformation part 132. However, as this portion is the wider-width part 133, its flexural rigidity is greater than the conventional case wherein the width of the leaf spring is made narrower than the width of the internal space of the body. Accordingly, if one attempts to make the female terminal smaller by reducing the width of the body than that of a conventional female terminal, a sufficient contact pressure will be secured. Moreover, it is also possible to enhance the contact pressure of the leaf spring without changing the body width in comparison with a conventional female terminal. Furthermore, as the body 110 is made tubular, a high rigidity is secured, and the body 110 will be hardly deformed under external forces. As the leaf spring 130 is retained inside the body except the wider-width part 133, the leaf spring 130 is protected against external forces.

The exposed-spring female terminal of the present invention includes an embodiment wherein a leaf spring alone is provided and no secondary leaf spring is provided. However, the exposed-spring female terminal 100 of the first embodiment is provided with a secondary leaf spring 140 on the restrained part 131 on the side, in the depth direction, opposite to the side on which the resilient deformation part 132 is provided, said secondary leaf spring 140 extends from the restrained part 131 in the depth direction and constitutes a double spring together with the leaf spring 130. With this arrangement, when a counterpart male terminal is inserted into this exposed-spring female terminal 100, the resilient deformation part 132 of the leaf spring 130 will be pushed by the male terminal to undergo resilient deformation in the height direction and approach toward the restrained part 131 and then contact the secondary leaf spring 140, and in turn, both the leaf spring 130 and the secondary leaf spring 140 will undergo resilient deformation together to provide a contact pressure between both the terminals. This illustrates, as an example, an embodiment wherein the present invention is applied to a female terminal using a double spring.

The position of the wider-width part of the leaf spring and the position of the openings in the exposed-spring female terminal according to the present invention are not limited by any embodiment. However, in the exposed-spring female terminal 100 of the first embodiment, the wider-width part 133 of the leaf spring 130 is provided in one end in the depth direction of the body 110 and the openings 113 are provided in the ends in the depth direction of the two vertical walls 112. With this arrangement, as the openings 113 are provided in the ends of the vertical walls 112, the openings 113 hardly induce a decrease in the rigidity of the body 110.

The exposed-spring female terminal of the present invention includes an embodiment wherein no stopper is provided. However, the exposed-spring female terminal 100 of the first embodiment is provided with a stopper 114 on one vertical wall 112 between the leaf spring 130 and the lateral wall 111, said stopper is to prevent excessive deformation of the leaf spring 130 by contacting the leaf spring 130 almost undergoing excessive deformation. With this arrangement, the leaf spring 130 is prevented from undergoing excessive deformation.

Figure 9:
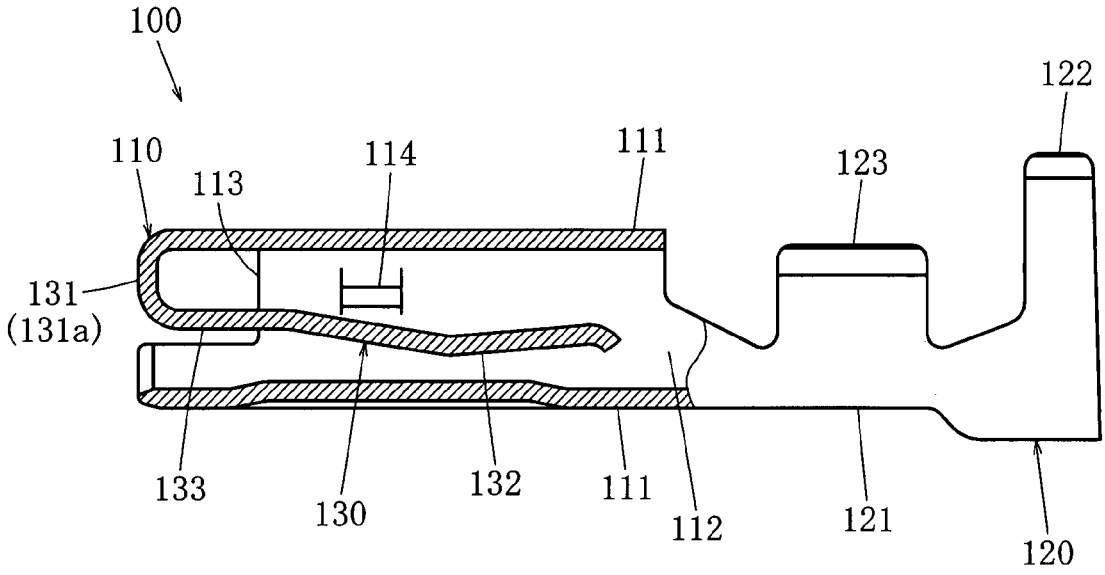
FIG. 9 is a side view of the exposed-spring female terminal of the second embodiment illustrating the body and the leaf spring thereof in longitudinal section.
Figure 10:
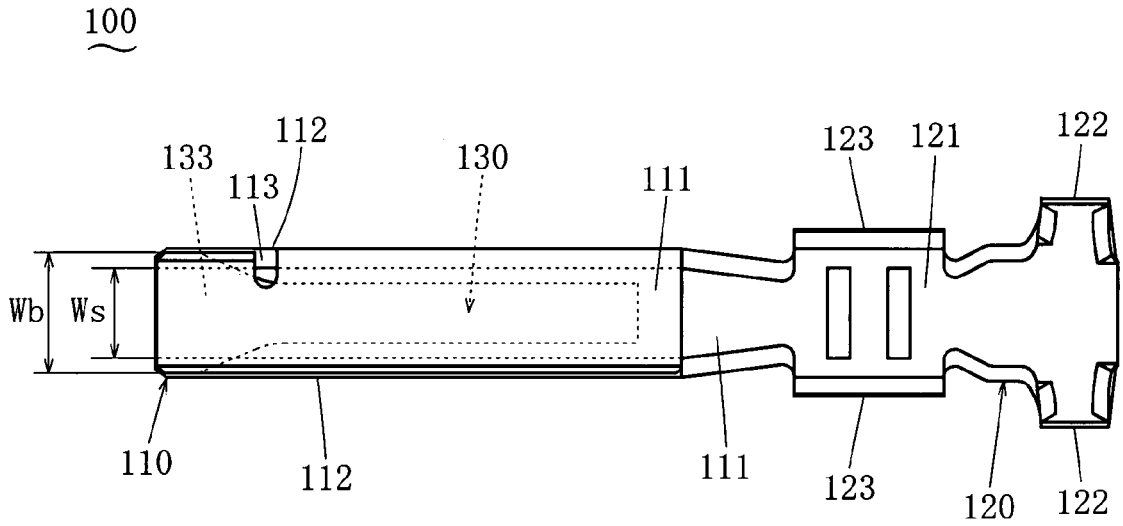
FIG. 10 is a plan view of the exposed-spring female terminal of the second embodiment.
Figure 11:
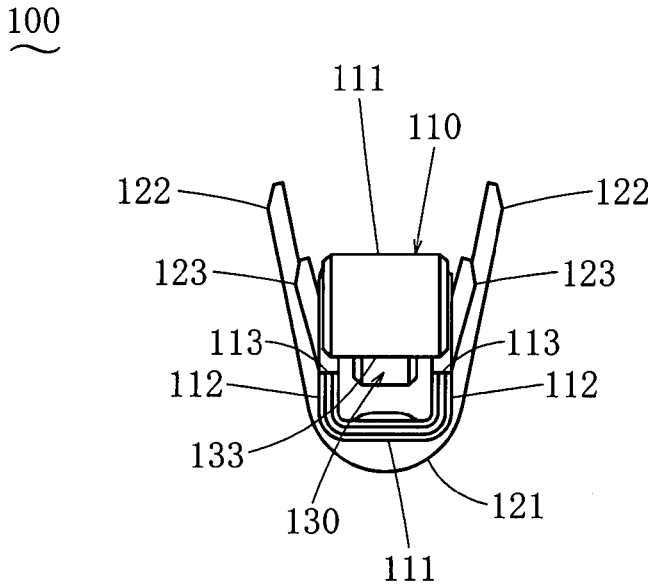
FIG. 11 is a front view of the exposed-spring female terminal of the second embodiment.
Figure 12:
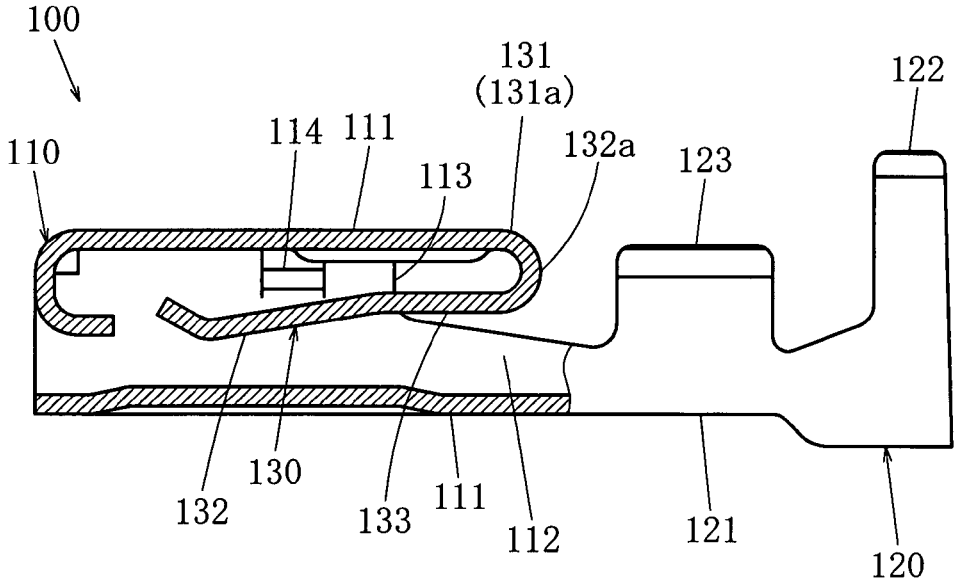
FIG. 12 is a side view of the exposed-spring female terminal of the third embodiment illustrating the body and the leaf spring thereof in longitudinal section.
Figure 13:
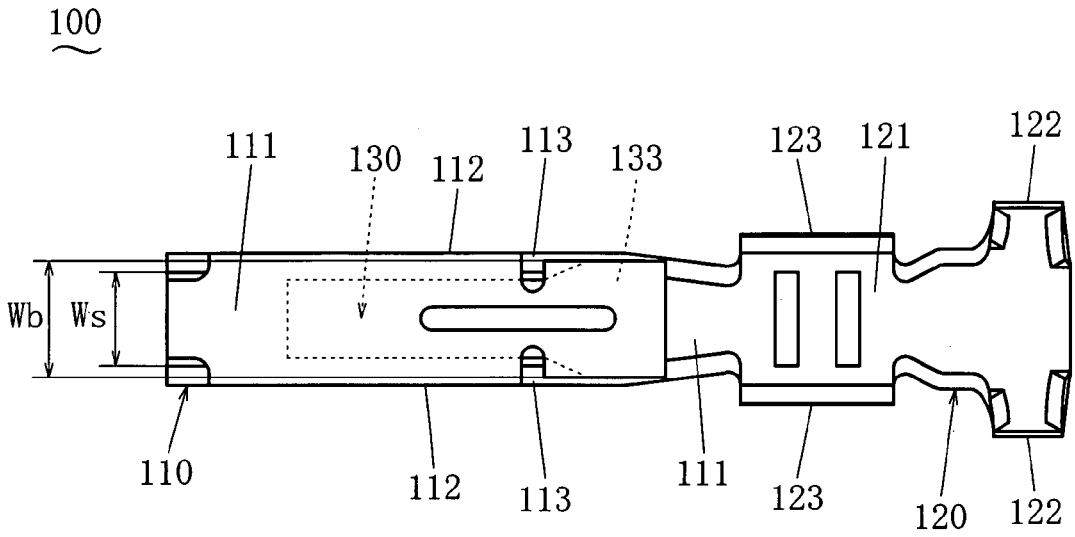
FIG. 13 is a plan view of the exposed-spring female terminal of the third embodiment.
Figure 14:
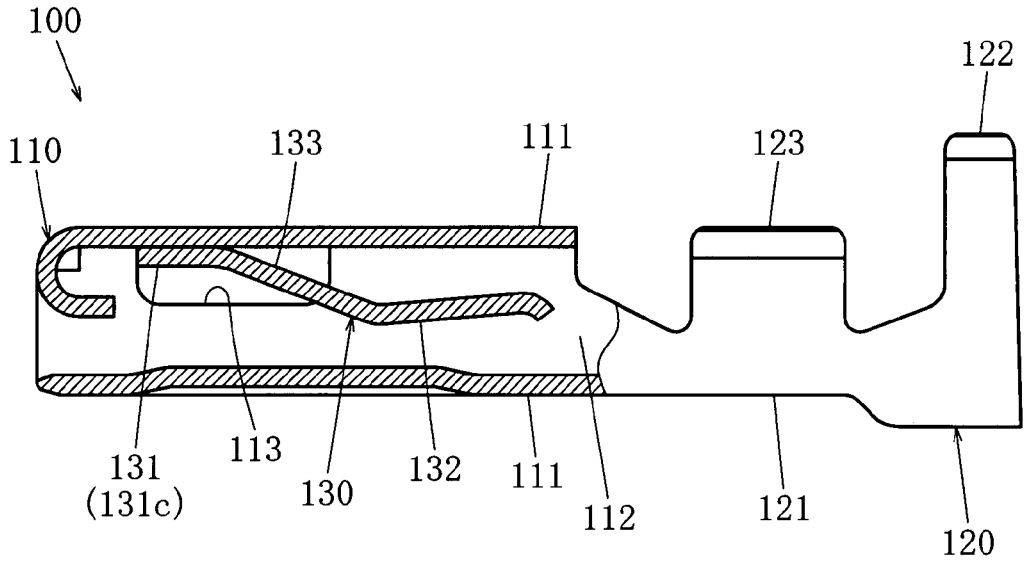
FIG. 14 is a side view of the exposed-spring female terminal of the fourth embodiment illustrating the body and the leaf spring thereof in longitudinal section.
Figure 15:
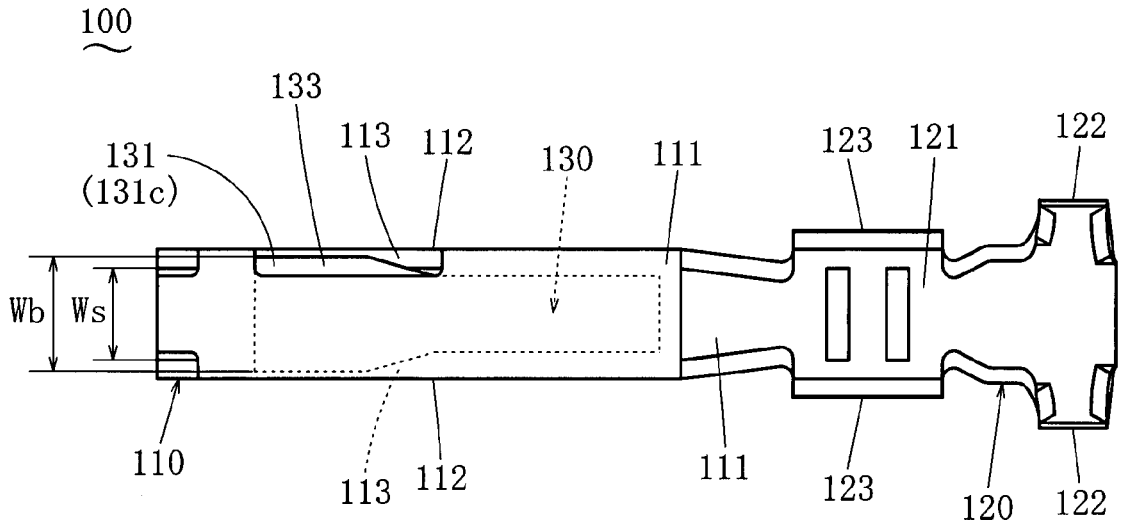
FIG. 15 is a plan view of the exposed-spring female terminal of the fourth embodiment.
Figure 16:
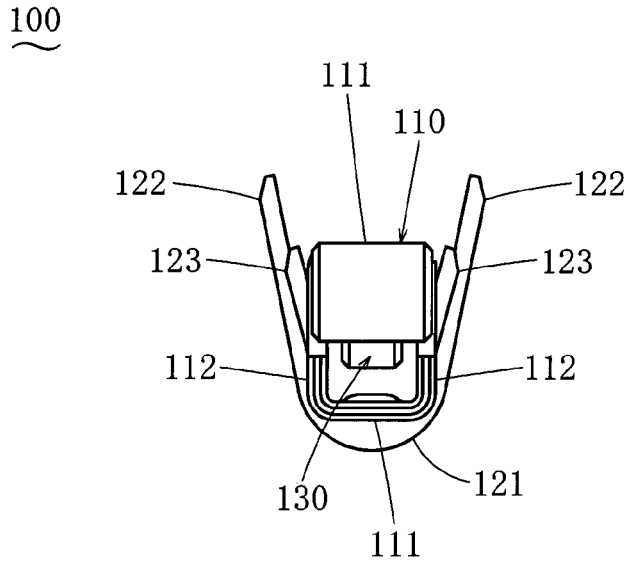
FIG. 16 is a front view of the exposed-spring female terminal of the fourth embodiment.

In the following, other embodiments will be described. Parts that exhibit identical functions to those of the respective parts of the exposed-spring female terminal of the first embodiment are given the identical marks to those used in said embodiment, and their descriptions are omitted. And only structures that differ from the structure of the first embodiment will be described. Exposed-spring female terminals 100 of these other embodiments provide actions and effects similar to those of the exposed-spring female terminal 100 of the first embodiment. FIG. 9 through FIG. 11 illustrate an exposed-spring female terminal 100 of the second embodiment, and FIG. 12 and FIG. 13 illustrate an exposed-spring female terminal 100 of the third embodiment. In the case of the exposed-spring female terminal 100 of the first embodiment, the integral part 131*a* is the portion that is bent when the leaf spring 130 is obtained by bending it from one vertical wall 112 of the body 110. In contrast to this, in the exposed-spring female terminal 100 of the second embodiment and the exposed-spring female terminal 100 of the third embodiment, the integral part 131*a* is a portion that is bent when the leaf spring 130 is obtained by bending it from one lateral wall 111 of the body 110. In the case of the second embodiment, the leaf spring 130 is obtained by bending it from an end at the front in the depth direction of the lateral wall 111 of the body 110, and in the case of the third embodiment, the leaf spring 130 is obtained by bending it from an end at the rear in the depth direction of the lateral wall 111 of the body 110. FIG. 14 through FIG. 16 illustrate an exposed-spring female terminal 100 of the fourth embodiment. In the case of the exposed-spring female terminal 100 of the fourth embodiment, the restrained part 131 of the leaf spring 130 is provided with a fixed part 131*c* that is fixed to the body 110. Here, the fixed part 131*c* is fixed to one lateral part 111. This fixed part 131*c* is a fixed portion of the leaf spring 130 when the leaf spring 130 being a member different from the body 110 is fixed to the body 110 by thermal fusion. Apart from this thermal fusion, fixing methods include, for example, swaging, press fitting and bonding.

In the case of the exposed-spring female terminal 100 of the first embodiment, the restrained part 131 of the leaf spring 130 is provided with the support part 131*b* that extends from the integral part 131*a* toward the resilient deformation part 132. In contrast to this, in the exposed-spring female terminal 100 of the second embodiment and the exposed-spring female terminal 100 of the third embodiment, no support part is provided and the restrained part 131 is constituted of the integral part 131*a* only, and the resilient deformation part 132 is extended from this integral part 131*a*. In the exposed-spring female terminal 100 of the fourth embodiment, no support part is provided and the restrained part 131 is constituted of the fixed part 131*c* only, and the resilient deformation part 132 is extended from this fixed part 131*c*. Like the exposed-spring female terminal 100 of the fourth embodiment, when a support part is provided in an exposed-spring female terminal of which restrained part has a fixed part, the support part is a portion that extends from the fixed part toward the resilient deformation part and is to be restrained from deformation when it touches the body.

In the exposed-spring female terminal 100 of the third embodiment, like the case of the first embodiment, the resilient deformation part 132 has a curved part 132*a* that extends from the restrained part 131 and curves in an approximately U-shaped form when seen in the width direction, and the end on the curved part 132*a* side of the restrained part 131 and the curved part 132*a* of the resilient deformation part 132 constitute the wider-width part 133 of which plate width Wb is greater than the dimension Ws between the inner faces of the two vertical walls 112. In contrast to this, in the exposed-spring female terminals 100 of the second embodiment and the fourth embodiment, no curved part is provided, and the resilient deformation part 132 is made to extend from the restrained part 131 substantially in the depth direction, a wider-width part 133, of which plate width Wb is greater than the dimension Ws between the inner faces of the two vertical walls 112, is provided from the restrained part 131 to the resilient deformation part 132 of the leaf spring 130, and openings 113 are provided in the two vertical walls 112 to receive the wider-width part 133.

In the cases of the exposed-spring female terminal 100 of the first embodiment and the exposed-spring female terminal 100 of the second embodiment, the wider-width part 133 of the leaf spring 130 is provided in the end at the front in the depth direction of the body 110, and the openings 113 are provided in the ends at the front in the depth direction of the two vertical Walls 112. In contrast to this, in the exposed-spring female terminal 100 of the third embodiment, the wider-width part 133 is provided in the end at the rear in the depth direction of the body 110, and the openings 113 are provided in the ends at the rear in the depth direction of the two vertical walls 112. Furthermore, in the exposed-spring female terminal 100 of the fourth embodiment, the wider-width part 133 is provided substantially in the middle in the depth direction of the body 110, and the openings 113 are provided substantially in the middle in the depth direction of the two vertical walls 112.

In any of the embodiments, the curved part, the secondary leaf spring, the stopper, etc. may be provided or they may not be provided. Furthermore, the present invention includes embodiments wherein features of the above-mentioned embodiments are combined. And, the above-mentioned embodiments just illustrate some examples of the exposed-spring female terminal according to the present invention. Accordingly, the exposed-spring female terminal of the present invention must not be construed limitedly on the ground of any description of these embodiments.

The disclosure of Japanese Patent Application No. 2006-110331 filed on Apr. 12, 2006 including specification, drawings and claims is incorporated herein by reference in its entirety.

The invention claimed is:

1. An exposed-spring female terminal comprising a tubular body having two lateral walls facing in a height direction and opposing to each other and two vertical walls facing in a width direction perpendicular to the height direction and opposing to each other, and extending in a depth direction perpendicular to both the height direction and the width direction;

a connecting part being arranged with the body on a rear side in the depth direction, being provided integrally with the body and being structured to connect to a conductor such as electric wire; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction; and the leaf spring being provided with a wider-width part extending from the restrained part to the resilient deformation part, of which plate width being larger than the dimension between the inner faces of the two vertical walls; and the two vertical walls being provided with openings for receiving the wider-width part, wherein at least one opening is formed by cutting away a portion of the vertical wall and a portion of an adjoining lateral wall corresponding to the cut-away portion of the vertical wall such that at least one lateral edge portion of the wider-width part is exposed exteriorly of the tubular body and overlaps a remaining portion of the cut-away vertical wall as viewed in plan view.

2. The exposed-spring female terminal according to claim 1, wherein the wider-width part of the leaf spring is provided in one end in the depth direction of the body, and the openings are provided in the ends in the depth direction of the two vertical walls.

3. The exposed-spring female terminal according to claim 1, wherein a stopper is provided on the vertical wall between the leaf spring and the lateral wall, said stopper is to prevent excessive deformation of the leaf spring by contacting the leaf spring almost undergoing excessive deformation.

4. The exposed-spring female terminal according to claim 1, wherein the restrained part of the leaf spring is provided with an integral part being integrally provided with the body or a fixed part being fixed onto the body.

5. The exposed-spring female terminal according to claim 4, wherein the resilient deformation part has a curved part extending from the restrained part and bending in an approximately-U-shaped form when seen in the width direction, and an end on the curved part side of the restrained part and the curved part of the resilient deformation part constitute the wider-width part of which plate width being larger than the dimension between the inner walls of the two vertical walls.

6. The exposed-spring female terminal according to claim 1, wherein the resilient deformation part has a curved part extending from the restrained part and bending in an approximately-U-shaped form when seen in the width direction, and an end on the curved part side of the restrained part and the curved part of the resilient deformation part constitute the wider-width part of which plate width being larger than the dimension between the inner walls of the two vertical walls.

7. An exposed-spring female terminal, comprising:

a tubular body having two lateral walls facing in a height direction and opposing to each other and two vertical walls facing in a width direction perpendicular to the height direction and opposing to each other, and extending in a depth direction perpendicular to both the height direction and the width direction;

a connecting part being arranged with the body on a rear side in the depth direction, being provided integrally with the body and being structured to connect to a conductor such as electric wire; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction; and the leaf spring being provided with a wider-width part extending from the restrained part to the resilient deformation part, of which plate width being larger than the dimension between the inner faces of the two vertical walls; and the two vertical walls being provided with openings for receiving the wider-width part, wherein the resilient deformation part has a curved part extending from the restrained part and bending in an approximately-U-shaped form when seen in the width direction, wherein an end on the curved part side of the restrained part and the curved part of the resilient deformation part constitute the wider-width part of which plate width being larger than the dimension between the inner walls of the two vertical walls, and wherein the restrained part is provided with a secondary leaf spring on the side, in the depth direction, opposite to the side on which the resilient deformation part is provided, said secondary leaf spring extends from the restrained part in the depth direction and constitutes a double spring together with the leaf spring.

8. An exposed-spring female terminal, comprising:

a tubular body having two lateral walls facing in a height direction and opposing to each other and two vertical walls facing in a width direction perpendicular to the height direction and opposing to each other, and extending in a depth direction perpendicular to both the height direction and the width direction;

a connecting part being arranged with the body on a rear side in the depth direction, being provided integrally with the body and being structured to connect to a conductor such as electric wire; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction; and the leaf spring being provided with a wider-width part extending from the restrained part to the resilient deformation part, of which plate width being larger than the dimension between the inner faces of the two vertical walls; and the two vertical walls being provided with openings for receiving the wider-width part, wherein the restrained part of the leaf spring is provided with an integral part being integrally provided with the body or a fixed part being fixed onto the body and wherein the restrained part of the leaf spring is provided with a support part which extends from the integral part or the fixed part toward the resilient deformation part and is restrained from deformation by contacting the body.

9. The exposed-spring female terminal according to claim 3, wherein the resilient deformation part has a curved part extending from the restrained part and bending in an approximately-U-shaped form when seen in the width direction, and an end on the curved part side of the restrained part and the curved part of the resilient deformation part constitute the wider-width part of which plate width being larger than the dimension between the inner walls of the two vertical walls.

10. The exposed-spring female terminal according to claim 9, wherein the restrained part is provided with a secondary leaf spring on the side, in the depth direction, opposite to the side on which the resilient deformation part is provided, said secondary leaf spring extends from the restrained part in the depth direction and constitutes a double spring together with the leaf spring.

11. An exposed-spring female terminal, comprising:

a tubular body having two lateral walls facing in a height direction and opposing to each other and two vertical walls facing in a width direction perpendicular to the height direction and opposing to each other, and extending in a depth direction perpendicular to both the height direction and the width direction;

a connecting part being arranged with the body on a rear side in the depth direction, being provided integrally with the body and being structured to connect to a conductor such as electric wire; and a leaf spring being arranged inside the body, with the plate width direction being substantially aligned with the width direction, and having a restrained part restrained by the body and a resilient deformation part extending from the restrained part in the depth direction when seen in the height direction and being capable of resilient deformation in the height direction, the leaf spring being provided with a wider-width part extending from the restrained part to the resilient deformation part, of which plate width being larger than the dimension between the inner faces of the two vertical walls; and the two vertical walls being provided with openings for receiving the wider-width part, wherein the restrained part of the leaf spring is provided with an integral part being integrally provided with the body or a fixed part being fixed onto the body, wherein the resilient deformation part has a curved part extending from the restrained part and bending in an approximately-U-shaped form when seen in the width direction, wherein an end on the curved part side of the restrained part and the curved part of the resilient deformation part constitute the wider-width part of which plate width being larger than the dimension between the inner walls of the two vertical walls and wherein the restrained part is provided with a secondary leaf spring on the side, in the depth direction, opposite to the side on which the resilient deformation part is provided, said secondary leaf spring extends from the restrained part in the depth direction and constitutes a double spring together with the leaf spring.

* * * * *